US005548978A

United States Patent [19]

Bongini et al.

[11] Patent Number: 5,548,978

[45] Date of Patent: Aug. 27, 1996

[54] FRONT LOADING WASHING MACHINE

[75] Inventors: Dino Bongini, Fabriano; Sandro Duri, Fiuminata; Andrea Stopponi, Matelica, all of Italy

[73] Assignee: Merloni Elettrodomestici S.p.A., Fabriano, Italy

[21] Appl. No.: 346,155

[22] Filed: Nov. 29, 1994

[30] Foreign Application Priority Data

Nov. 30, 1993 [IT] Italy ..... TO93A0909

[51] Int. Cl.[6] ..... D06F 39/02

[52] U.S. Cl. ..... 68/17 R

[58] Field of Search ..... 68/17 R, 23.1, 68/23.2, 24, 139, 140, 210; 134/93

[56] References Cited

U.S. PATENT DOCUMENTS

| | | | |
|---|---|---|---|
| 2,352,363 | 6/1944 | Bassett, Jr. | 68/23.1 |
| 2,899,815 | 8/1959 | Hetrick | 68/17 R |
| 2,931,505 | 4/1960 | Winslow | 68/140 X |
| 2,960,780 | 11/1960 | Stilwell . | |
| 3,022,656 | 2/1962 | Bergeson et al. | 68/17 R X |
| 3,333,739 | 8/1967 | Clearman et al. | 68/17 R X |

FOREIGN PATENT DOCUMENTS

| | | | |
|---|---|---|---|
| 630643 | 7/1963 | Belgium | 68/210 |
| 0406115 | 1/1991 | European Pat. Off. . | |
| 0655523 | 5/1995 | European Pat. Off. . | |
| 1287987 | 2/1962 | France | 68/24 |
| 1188546 | 3/1965 | Germany | 68/139 |
| 1460888 | 5/1969 | Germany | 68/17 R |
| 386373 | 7/1960 | Switzerland . | |
| 1155774 | 7/1967 | United Kingdom . | |
| 2029862 | 3/1980 | United Kingdom . | |

*Primary Examiner*—Philip R. Coe
*Attorney, Agent, or Firm*—Herbert Dubno; Yuri Kateshov

[57] ABSTRACT

A front loading laundry washing machine, of the domestic type, whereby the body of the washing agents distributor is mounted on the frontal wall of the washing chamber, in correspondence with the respective aperture, and facing towards the inside of the basket through the aperture of the latter.

17 Claims, 3 Drawing Sheets

FRONT LOADING WASHING MACHINE

FIELD OF THE INVENTION

The present invention relates to a front loading laundry washing machine, of the domestic type, comprising a cabinet, a washing chamber arranged whithin the cabinet, a basket for the laundry and a washing agent distribution device, the basket being mounted in the washing chamber so as to rotate around a substantially horizontal axis, the cabinet, the washing chamber and the basket each having an aperture in the respective frontal walls for allowing the loading and the unloading of the laundry in the inside of the basket, the three apertures, during the operation of the machine, being closed by a door.

BACKGROUND OF THE INVENTION

Domestic laundry washing machines can be of the top loading or front loading type, according to the arrangement of the opening for the loading and unloading of the clothes from the machine. The existence of two such categories of machines is due to various factors, from among which it is to be remembered the availability of space within the house, the aesthetic needs and, last but not least, the simple preference of the user for one type of laundry washing machine compared to the other.

Generally laundry washing machines are made up of parallelepiped cabinet containing a tub assembly. The such tub assembly includes a container for the washing liquid, or a tub in a strict sense of the word, within which a basket for the laundry is mounted so as to enable it to rotate around a substantially horizontal axis.

In the case of the front loading machines the basket, of a cylindrical form, has an opening in its frontal wall, substantially coaxial with two openings respectively present on the frontal wall of the tub and of the cabinet of the machine. The laundry is thus loaded and unloaded in relation to the basket through such openings that, during the functioning of the machine, are closed by a door, generally of a circular shape.

Inside the cabinet, appropriate means is provided for producing the rotation of the basket, and includes an electric motor, belts and pulleys, a means for the supply and the discharge of the washing liquid from the tub (hydraulic conduits and one or more pumps), and a distributor device for washing agents, able to supply at determined times of the functioning cycle of the laundry washing machine the detergent or other additives inside the tub.

In front loading washing machines of the known type, the detergent distributor, which is usually arranged in the upper part of the cabinet of the machine, has the form of a drawer with several distinct compartments, and has a conduit which connects the drawer vane with the upper zone of the washing tub. The drawing of the detergent from the distributor usually occurs by means of a water flow which conveys the detergent in the tub over a period varying between 60 and 120 seconds. Most of the detergent is of in a time varying within 60" and 120"; most of the detergent is of course drawn in the initial seconds and therefore the detergent concentration in water is initially very high. This detergent, that has not been able to dissolve, mixed with water, deposits in the lowermost parts of the tub, where the duct of the drainage pump, which for hydraulic reasons must be in the lowermost point of the hydraulic system, is arranged as a result an undesirable detergent accumulation in the pipes is formed. For solving this problem, different devices have been proposed, which provide for recirculating a part of the accumulated detergent. See for example patent documents DE-A-2.655.556 and IT-B1.082.306. Such solutions, even if they allow for a partial recovery of the wasted detergent, are often complex and inefficient.

Another important problem, which is typical of known front loading laundry washing machines, is the difficulty in the loading and unloading of laundry.

OBJECTS OF THE INVENTION

The principal object of the present invention is to provide a front loading laundry washing machine. Still another object of the invention to provide a laundry of showing the laundry formation of detergent accumulation.

SUMMARY OF THE INVENTION

These and other objects of the present invention are attained by a front loading laundry washing machine, of the domestic type, comprising a cabinet, a washing chamber arranged whithin said cabinet, a basket for the laundry and a washing agent distribution device, the basket being mounted in the washing chamber so as to rotate around a substantially horizontal axis, the cabinet, the washing chamber and the basket each having an aperture in the respective frontal walls for allowing the loading and the unloading of the laundry in the basket, the three apertures, during the operation of the machine, being closed by a door, wherebythe body of the washing agents distributor is mounted on the frontal wall of the washing chamber, in correspondence with the respective aperture, and in order to face towards the inside of the basket through the aperture of the latter.

BRIEF DECRIPTION OF THE DRAWING

The above further characteristics and advantages of the present invention will become more easily apparent from description which follows and from the annexed drawings, wherein.

SPECIFIC DESCRIPTION

Figure 1:
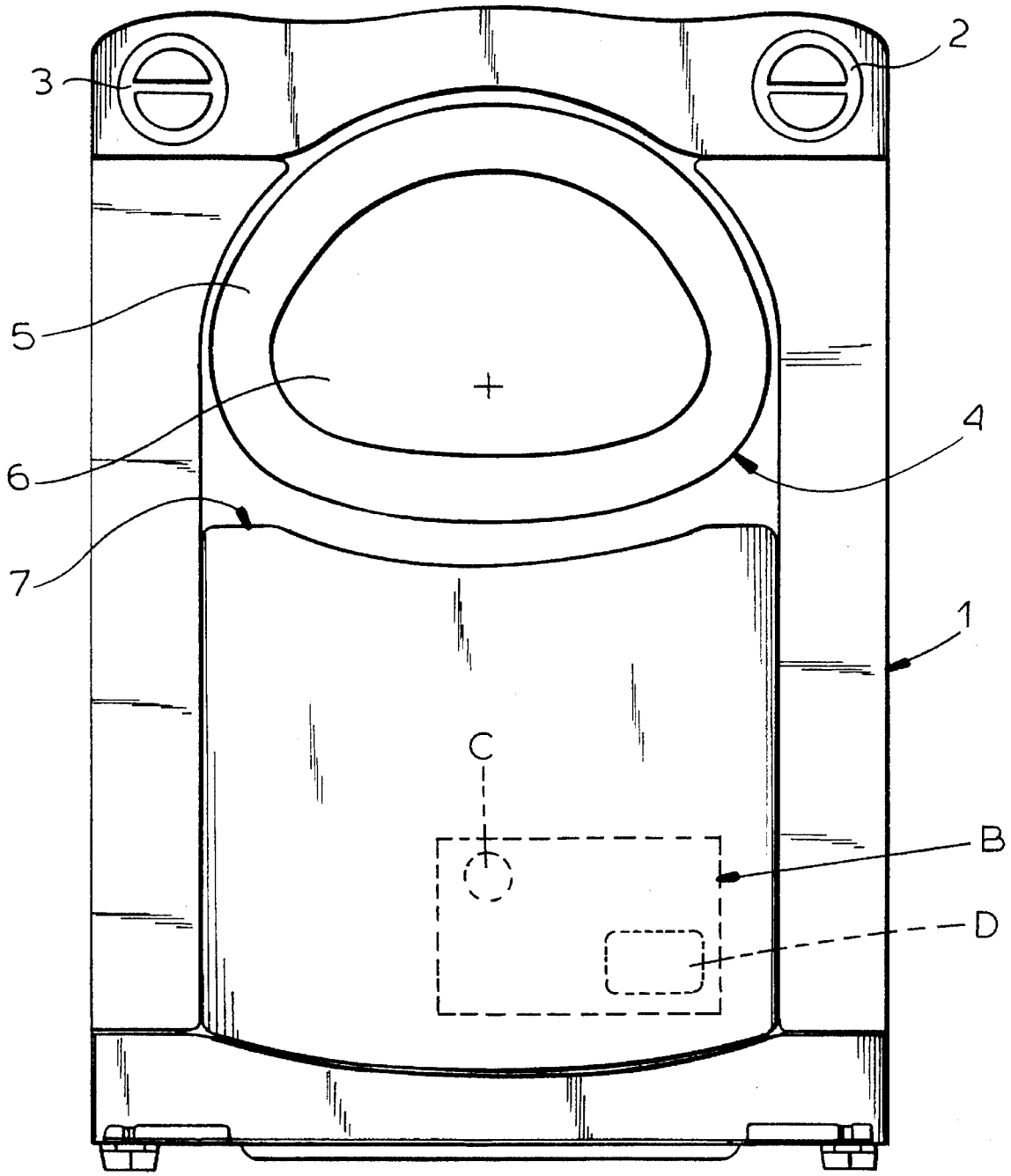
FIG. 1 is a schematically shown frontal view a front loading laundry washing machine according to the present invention.

As can be seen from the drawing, in the laundry washing machine which will be described with reference to a preferred, but not limiting, embodiment of the invention, the tub-basket assembly and the charging openings are substantially in a position being higher by comparison to the front loading laundry washing machine according to the prior art.

For a description of the means which allows to obtain such a substantial elevation reference can be made to the contents of the concurrently filed patent application having the title "SIMPLIFIED FRONT LOADING WASHING MACHINE" in the name of the same applicant (Ser. No. 08/346,154).

In this concurrently filed application a laundry washing machine is described wherein the barycentre of the oscillating group (basket-tub-equilibrating masses) has been substantially lowered with respect to the laundry washing machine of the known type, with a contemporary raising of the group itself by a value being substantially equal to the lowering of the barycenter.

The masses that combine to locate the cited barycentre, besides the tub, basket and motor, are the counterweights. In accordance with the concurrently filed patent application, the counterweights are brought below the tub, also allowing for the elimination of substantial obstacles in the area of the opening of the basket and in the area above the tub.

Since there is no need for a frontal counterweight, space in the frontal part of the machine is recovered. Therefore in this area the distributor of washing agents can be housed, so making also free the upper part of the cabinet of the machine (which is already partially free by the absence of the upper counterweight).

The space recovered in the frontal part and in the upper part of the cabinet allows the raising of the tub group and, therefore, of the opening of the loading door, towards the most ergonomic position possible for a front loading machine.

Finally, the space recovery in the frontal part of the cabinet allows for the location of a support surface for simplifying the loading/unloading operations of the laundry, without having the bulk of the machine exceed that of the European-type machines according to the prior art.

In FIG. 1, the cabinet 1 in sheetplate of the laundry washing machine is shown, of substantially parallelepiped form and of size in the order of the known front loading laundry washing machine of the European type (Eg. height cm. 85, depth cm. 55, width cm. 59); the machine has a knob 2 for the selection of the washing cycle and a knob 3 for the selection of temperatures of the washing liquid are shown respectively; other command devices and displays (such as buttons, switches, lights, etc.) have not been represented in the figure for simplicity. Reference number 4 denotes the loading door of the machine and this door has a generally flattened form (approximately triangular or elliptic) and a width which is substantially greater than that of common circular portholes of the laundry washing machines according to the known art. The door 4 includes a frame 5 and a transparent central part 6, for example in glass, duly shaped towards the interior of the cabinet. The door 4 is furthermore equipped with generally known hinges and with a door blocking device [these elements are not represented inasmuch they are of known realisation], for its opening in lateral sense.

A support surface 7 is substantially central if compared to the frontal wall of the cabinet of the machine and is designed to assume two working positions, as is described below.

Figure 2:
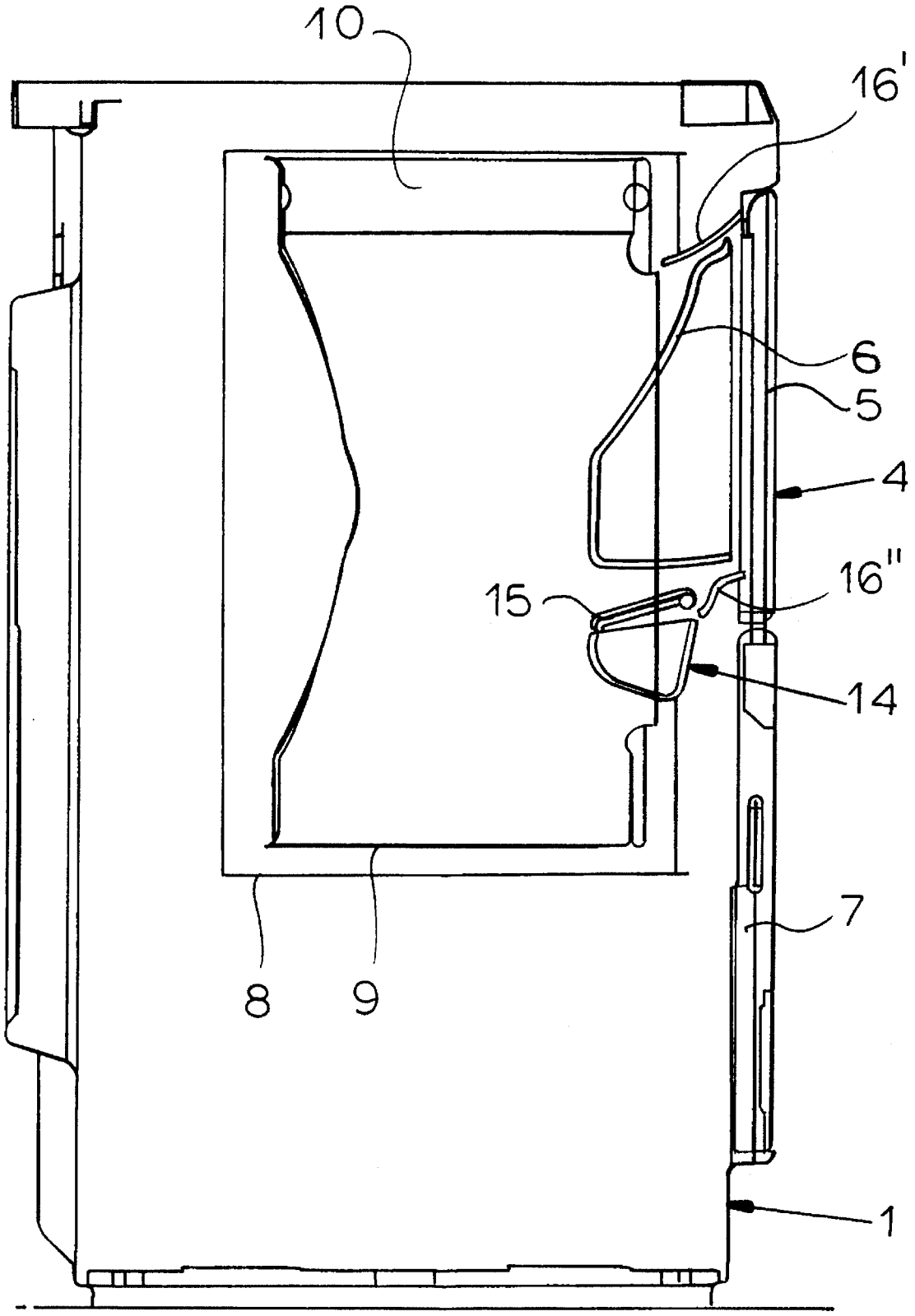
FIG. 2 is a vertical sectional view of the front loading laundry washing machine according to the present invention, in the closed position of the door.
Figure 3:
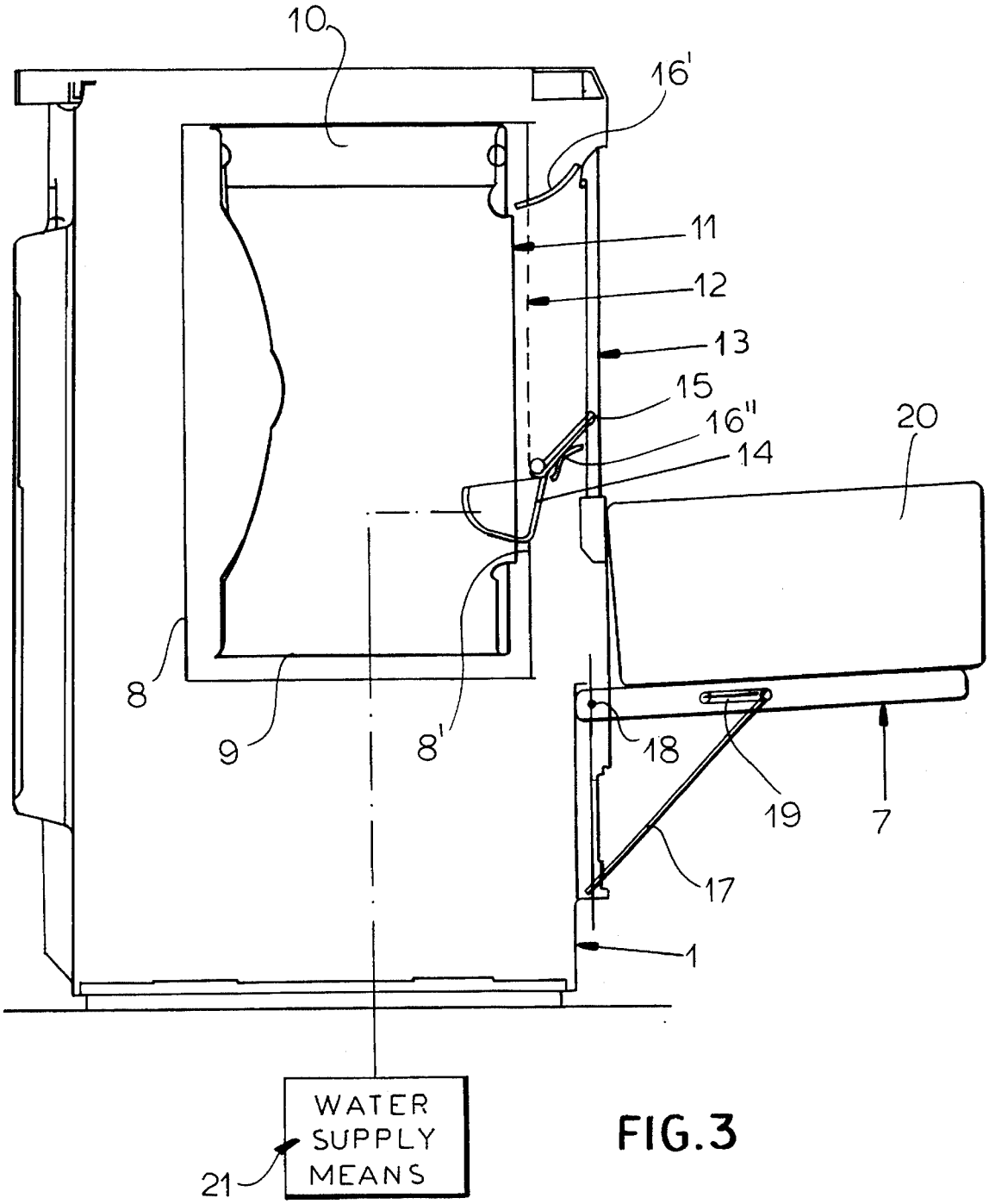
FIG. 3 schematically shows in vertical section a front loading laundry washing machine according to the present invention, in the open position of the door.

In the FIGS. 2 and 3 the laundry washing machine is shown in a vertical section in closed door and open door conditions (in FIG. 3 the door is not represented for sake of greater clarity).

Reference number 8 indicates the washing tub 8 of the machine receives a basket 9, within which a basket 9 mounted in a known way, with a horizontal rotation axis and placed in movement by way of an electric motor (not represented). A dragging element 10 facilitates the movement of the laundry inside the basket 9. Reference number 11 (see FIG. 3) indicates a circular opening present in the frontal wall of the basket 9, reference number 12 indicates an opening in the frontal wall of the washing tub 8, while reference number 13 indicates an opening in the frontal wall of the cabinet 1 of the laundry washing machine.

Reference number 14 indicates a body of a distributor for washing agents, which is integral with the frontal wall of the washing tub 8. In particular the body 14 is fixed on the lower edge 8' of the opening 12, in order to directly protrude towards the interior of the basket 9. The distributor 14 has in its upper part a flap 15. A bellows seal 16 is shown hanging; the upper part 16' of the seal which extends between the opening 13 of the cabinet 1 and the opening 11 of the basket 9, through the opening 12 of the tub 8; the lower part 16" of the seal extends between the opening 13 of the cabinet 1 and the body 14 of the washing agents distributor.

From a comparison between the FIGS. 2 and 3 it can also be noted that the surface 7 has an articulation system 17-18-19, also known generally and allowing the support surface 7 to assume two different positions:

- a rest position, (FIG. 2), in which the surface 7 is folded and housed in a suitable seat, so that it does not exceed the frontal dimensions of the cabinet 1; and
- a work position (FIG. 3), in which the surface 7 is raised and can thereby realise an ideal support for a container 20 of clothes to be loaded or unloaded from the machine.

In the seat of the surface 7, for example in the area B in FIG. 1, the door is located for an easy access to the functional elements of the machine; such as for example the filter C of a pump for its periodic cleaning, and an electronic control card D of the laundry washing machine, in the case of maintenance. For having easy access to such doors, that are normally hidden from view, it is sufficient to bring the surface 7 in the position of FIG. 3.

The washing agent distributor according to the invention may be realized in any known form and technique, naturally in the respect of normatives in force.

For example it can be provided with at least one conduit coming from the supply tube of the water mains to the machine and connected to the body 14. In the underside of such body 14, in the portion that protrudes inside of the basket 9, openings which are sufficiently small for containing the detergent in powder can be provided however such openings are permeable to the mixture that is formed as a result of the dilution of the detergent with the water coming from the canalisation.

Thus, at a predetermined stage of the washing cycle, the programming device of the machine will allow for the opening of a solenoid valve, in such a way that a stream of water from water supply means 21 penetrates the body 14 and that the water-detergent mixture that consequently formed, can flow directly in the basket 9 through the lower openings.

Moreover it is clear that other forms and solutions are possible for the practical realisation of the washing agents distributor in the machine according to invention. For example the discharge of washing agents could be determined by overflow, by supplying the body 14 with water, until the water-detergent mixture reaches a certain level and flows from the body 14 directly in the basket 9. In such a case, the opening of the flap 15 could be caused by the same water pressure within the body 14.

In the preferred, but not exclusive, embodiment of the invention, the washing agents distributor is a type of "pouch" integral to the frontal wall of the washing tub and directly facing the interior of the basket. In agreement with such inventive idea, and with the abovementioned embodiment, the detergent can directly and quickly reach between the clothes, preferably already diluted and in an optimal concentration. A risk that the detergent accumulates in the lower space between the tub and the basket is eliminated because of the discharge duct. In other words, according to the invention, the washing agents distributor 14 has a function being very similar to that obtained with the use of containers, or so called "balls", which are inserted in the basket together with the clothes. The detergent is not necessarily activated in the course of the first loading of water in the tub, as is the case with the the balls.

The cited position of the washing agents distributor 14 is similarly convenient for the charging of the detergent and for the periodic cleaning of its container, that for this purpose will be at least in part advantageously removable.

Furthermore, another advantage of the positioning of the distributor 14, directly facing the interior of the basket, is that in case of errors in the charging of the detergent, the detergent tends to fall inside the machine, and not on the floor as is the cue with the machines according to the known art.

Apart from the embodiment here described with reference to FIGS. 1–3, the particular location of the washing agents distributor 14, also allows simplification of the loading and unloading of the clothes.

In the known art, for facilitating such operations, attempts have been made in order to increase the size of the basket opening, by enlargement; such a partial solution has also been demonstrated as unsatisfactory. In fact, the greater size of the opening of the basket determines a minor capacity of its frontal wall in its function of preventing the exiting of clothes, once the latter have been introduced in the basket or on the moment of opening the porthole, in the unloading phase of laundry from the machine.

On the contrary, according to the invention it is possible to provide a very large loading opening 11 and thus allowing an easy loading and unloading of the laundry. The lower part of the opening 11 is obstructed by the washing agents distributor 14, that acts as a containing element in the moment of the extraction of clothes, while the upper part of the opening 11 is instead obstructed, in use, by the door 4–6. It is specified for this purpose that, from tests carried out, on the front loading laundry washing machine according to the invention, the ratio between the diameter of the opening 11 and the diameter of the basket 9 may be in the order of about 0.75, while in machines actually available on the markets, the ratio between the diameter of the opening of the basket and that of the basket is in the order of 0.55.

It is also to be considered that, to in the case shown in FIGS. 1–3 the loading and unloading of clothes is greatly simplified also in virtue of the position of the openings 11–13, that are substantially arranged in the upper half of the frontal wall of the cabinet 1 of the machine, in proximity of the upper surface of the latter, and therefore in a position which is as ergonomic as possible for a front loading machine.

A further advantage of the arrangement of the washing agent distributor is that there are no problems in opening the door even in the presence of water inside the tub (naturally in respect of safety regulations), because the body 14 forms in practice a "bank", that raises in practice the lower edge of the opening of the tub, so minimizing the risk of liquid loss.

As it can be imagined, the functioning of the laundry washing machine according to the invention is very simple.

For the loading of clothes, the user opens the door 4, for example by way of a suitable button present in the upper part of the cabinet, 1, and raises the surface 7, in order to carry the clothes container 20. Such situation is illustrated in FIG. 3.

At this point the clothes can be introduced into the basket 9, in a very easy way, through the openings 11–13. Just as easy is the charging of the washing agent in the dispenser 14, after which the flap 15 is closed (the charging with washing agent can obviously also be carried out before loading of the clothes).

Once the clothes and detergent have been loaded, the user can close the door 4–6, initiate the washing cycle and eventually fold away the surface 7. This situation is illustrated in FIG. 2.

As with the known techniques the washing water will be loaded up to a certain level in the tub 8 and, at an appropriate moment of the operating cycle, the programming device of the machine will command the delivery of the washing agents through the distributor 14, for example in the ways described above.

The water-detergent washing mixture flows directly between clothes contained in the basket 9 and the washing cycle proceeds in the known way, but in absence of wastes and/or accumulation of the agent on the bottom of the tub 8.

Once the washing cycle has finished, the user can unload the clothes from the machine, something that may be carried out in a simple and easy way, opening the door 4–6 and making use of the surface 7.

From the description the characteristics and advantages of the front loading laundry washing machine according to present the invention are clear.

Numerous variants are possible to the laundry washing machine of the present invention, regarding for example the shape of the door.

As previously said, even the shape of the distributor 14 may be different from that illustrated as an example; advantageously the shape of the body of the distributor 14 and of the glass 6 can be chosen so as to be mutually completed, even with the purpose of favouring the correct and regular movement of the laundry within the basket.

We claim:

1. A front loading laundry machine, comprising:

a housing having a front side provided with a door opening;

a door mounted on said front side and displaceable between closed and open positions thereof, said door opening being closed by said door in the closed position thereof;

a washing chamber mounted in said housing and formed with a respective front wall, said wall having a chamber opening and being juxtaposed with said front side of the housing;

a laundry basket mounted in said chamber and rotatable about a horizontal axis and formed with a basket opening, the door, chamber and basket openings being aligned with one another; and washing agent distribution means for delivering a detergent into said basket in said closed position of the door, said distribution means being mounted on the front wall of said chamber and extending inwardly therefrom through said basket opening into said basket.

2. The laundry machine defined in claim 1 wherein said distribution means includes a removable body mounted on a lower edge of said chamber opening and protruding into the basket.

3. The laundry machine defined in claim 2, further comprising supply means for delivering water to said body.

4. The laundry machine defined in claim 3 wherein said body is formed with discharging means communicating with supply means for delivering a water-detergent mixture into said basket.

5. The laundry machine defined in claim 4 wherein the body is formed with respective floor and side walls, the discharging means including a plurality of drain holes formed in said body and open into said basket for filtrating said mixture.

6. The laundry machine defined in claim 5 wherein each of said holes is sufficiently small to contain the detergent but permeable to the mixture.

7. The laundry machine defined in claim 5 wherein said holes are formed in said floor of said body.

8. The laundry machine defined in claim 5 wherein said holes are formed in said side walls of the body.

9. The laundry machine defined in claim in claim 3 wherein said body prevents voluntary exiting of the laundry.

10. The laundry machine defined in claim in claim 1 wherein said housing is formed with a housing bottom, said chamber being formed with a chamber bottom spaced from said housing bottom at a substantial distance.

11. The laundry machine defined in claim 1 wherein said chamber opening is formed in an upper half of said housing.

12. The laundry machine defined in claim 1, further comprising a support formed on said front side and swingable about a support axis extending horizontally perpendicular to said horizontal axis between a rest position and a working position, said support having a support surface extending in a plane parallel to a plane of said front side in said rest position and lying in a plane perpendicular to said plane of the front side in the working position.

13. The laundry machine defined in claim 12 wherein said front side is provided with a plurality of windows covered by said support in the rest position thereof.

14. The laundry machine defined in claim 1 wherein a diameter of the basket opening is more than 0.6 of a diameter of the basket.

15. The laundry machine defined in claim 1, further comprising a seal extending between said door and chamber openings.

16. The laundry machine defined in claim 1 wherein said door is provided with a respective transparent window tapering inwardly toward the chamber.

17. A front loading laundry machine, comprising:

a housing having a front side provided with a door opening;

a door mounted at said door opening on said front side and displaceable between closed and open positions thereof, said door opening being closed by said door in the closed position thereof;

a washing chamber mounted in said housing and formed with a respective front wall, said wall having a chamber opening and being juxtaposed with said front side of the housing;

a laundry basket mounted in said chamber and rotatable about a horizontal axis and formed with a basket opening, the door, chamber and basket openings being aligned with one another; and a washing agent distribution device, comprising a body forming a container for a washing agent mounted on an edge of said chamber opening and extending inwardly therefrom, whereby said body prevents involuntary exiting of the laundry from the basket.

* * * * *